US008046878B1

(12) United States Patent
Matrejek

(10) Patent No.: US 8,046,878 B1
(45) Date of Patent: Nov. 1, 2011

(54) BAG AND CLOTHESLINE CLAMP

(76) Inventor: Eugene J. Matrejek, Kissimmee, FL (US)

( * ) Notice: Subject to any disclaimer, the term of this patent is extended or adjusted under 35 U.S.C. 154(b) by 775 days.

(21) Appl. No.: 12/126,179

(22) Filed: May 23, 2008

(51) Int. Cl.
*B65D 33/16* (2006.01)

(52) U.S. Cl. ..... 24/30.5 L; 24/30.5 R

(58) Field of Classification Search ..... 24/30.5 L, 24/30.5 R, 460, 462; 383/69
See application file for complete search history.

(56) References Cited

U.S. PATENT DOCUMENTS

| | | | | | |
|---|---|---|---|---|---|
| 890,366 | A * | 6/1908 | Manahan | 383/69 |
| 905,897 | A * | 12/1908 | Manahan | 383/69 |
| 2,021,609 | A * | 11/1935 | Pippert | 383/69 |
| 5,116,139 | A * | 5/1992 | Young et al. | 383/69 |
| 5,400,929 | A * | 3/1995 | Lopez Gonzalez | 383/69 |
| 5,462,222 | A * | 10/1995 | Boeck, II | 383/69 |
| 5,752,297 | A * | 5/1998 | Ramey | 24/462 |
| 5,983,460 | A * | 11/1999 | Hyde et al. | 24/30.5 R |
| 6,678,922 | B2 * | 1/2004 | Comer et al. | 24/30.5 R |

* cited by examiner

*Primary Examiner* — Robert Sandy

(57) ABSTRACT

A bag and clothesline clamp is constructed of a pliable, tubular hose that has a slit opening along the length and two opposite ends wherein at least one is notched at an angle of 45° away from the slit opening; a slot opening formed at least partially through the slit opening by removing a narrow strip of hose parallel to an axis of the hose for ease of insertion of the bag or the clothesline.

3 Claims, 4 Drawing Sheets

BAG AND CLOTHESLINE CLAMP

FIELD OF THE INVENTION

The present invention generally relates to a clamping device and more particularly, relates to a bag and clothesline clamp.

BACKGROUND OF THE INVENTION

Bag clamps and clothesline clamps are two of the most used tools in most households. The bag clamp is used to reseal an open plastic or foil bag that contains a variety of snack food, chips, cereal or bread, etc., while clothes clamps is used to keep clothes hanging on a clothesline from being blown off the line by wind. It would be desirable if a single clamp can be provided for use in both applications.

It is therefore an object of the present invention to provide a bag and clothesline clamp that does not have the drawbacks or shortcomings of the conventional clamps.

SUMMARY OF THE INVENTION

In accordance with the present invention, a bag and clothesline clamp is provided.

In a preferred embodiment, the present invention bag and clothesline clamp is provided in a length of a pliable, tubular hose that has a slit opening along the length and two opposite ends wherein at least one is notched at an angle of 45° away from the slit opening; a slot opening formed at least partially through the slit opening by removing a narrow strip of hose parallel to an axis of the hose for ease of insertion of the bag or the clothesline.

BRIEF DESCRIPTION OF THE DRAWINGS

The invention will now be described, by way of example, with reference to the accompanying drawings, in which.

DETAILED DESCRIPTION OF THE PREFERRED AND ALTERNATE EMBODIMENTS

The present invention discloses a bag and clothesline clamp that can be advantageously used for both applications.

The present invention bag and clothesline clamp is a kitchen tool that can be used to tightly seal a wide range of open packages such as snack bags, potato chips, cereal, bread, bags, and other foods as well as can be used as an improved clothespin for use in securing garments on a clothesline. The present invention consists of a flexible piece of PVC tubing, measuring ¾ inch high, 3 inches long, and 1/16 inch thick. It also features a slit located across the entire bottom length of the tubing. To use the present invention simply slide the clamp horizontally while holding the snack bag in the other then slide the opening over the bag to lock into place and provide an airtight closure on the snack bag, bread bag, etc. The clamp seals the entire width of the bag and will be inexpensive and practical in keeping food products fresh. When using the clamp as a clothespin, a person can simply place the garment over the line and then slide the open end of the tube over the garment. This keeps clothes secured to a line in a more effective manner than conventional clothespin. This product can be produced form plastic and in a side variety of sizes and colors. It can also be used to secure hobby items.

The present invention bag and clothesline clamp fulfills the need for a multi-purpose gadget that keeps packages of food airtight as well as garments on a clothesline. The appealing features of the present invention are its convenience, durability, reusability, ease of use, time-and-cost-savings for a consumer. Its simple to attach onto any bread or snack bag. The clamp can be used by homemakers who wish to ensure that the food products remain sterile and airtight in their original packages. It keeps snacks and other foods fresh for a longer period of time and can prevent food wastage. It saves consumers a considerable amount of money on groceries. It provides the user with an efficient way to close bread, snack, cereal frozen vegetables, or other food bag. Its easy to open and close and will keep expensive snacks fresh in a tightly closed container. It can be used to secure clothes and will replace standard clothespins for use in securing clothes on a line and will be more effective and easy to use. The specially designed clip keeps clothes secured to the line and prevent them form blowing off and falling onto the ground. It will prevent clothes form having to be washed a second time and will simplify the laundering process. It will be easy to use, effective, reasonably priced and durable.

Figure 1:
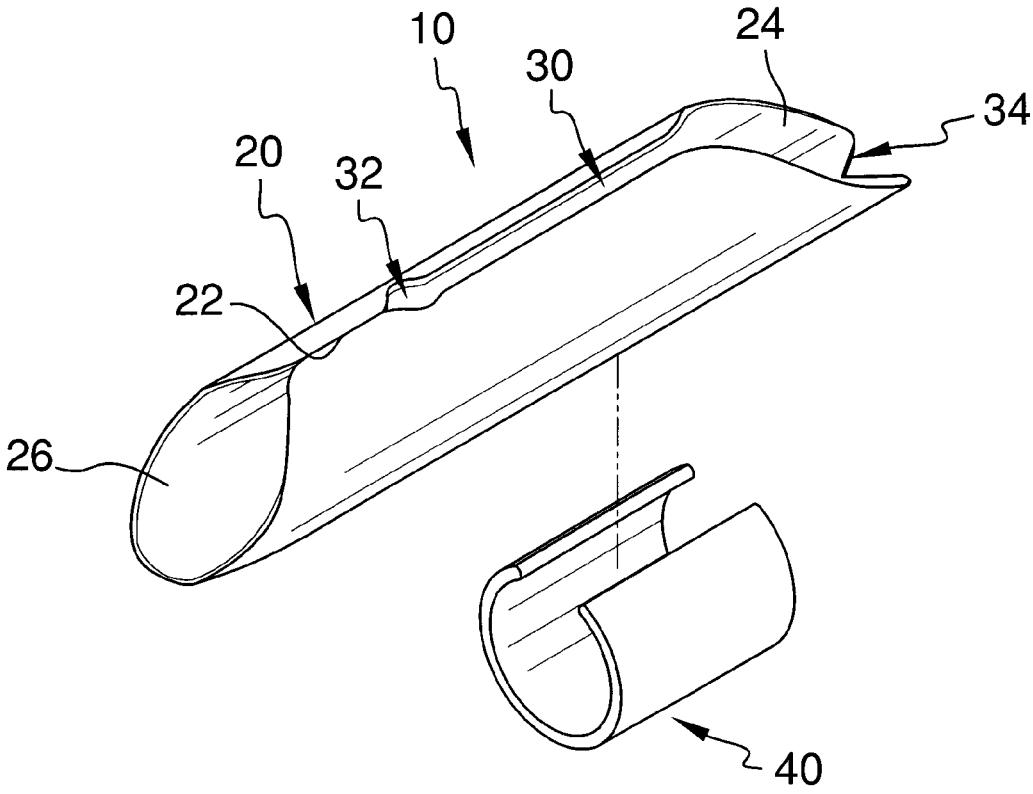
FIG. 1 is a perspective view of the present invention bag and clothesline clamp and an optional outer clamp.

Referring initially to FIG. 1, wherein a perspective view of the present invention bag clothesline 10 is shown. The clamp 10 is provided in a length of a pliable, tubular hose 20, which has a slit opening 22 along the length and two opposite ends 24, 26 wherein at least one is notched at an angle of about 45° away from the slit opening 22. A slot opening 30 is formed at least partially through the slit opening 22, i.e. to about ⅔ of the length of the slit 22 shown in FIG. 1, by removing a narrow strip of holes parallel to an axis of the hose 20 for ease of insertion of the bag 50 (shown in FIG. 4) or the clothesline 60 (shown in FIG. 4).

The present invention bag and clothesline 10 may further include an outer clamp 40 of C-shape for locking onto the exterior surface of the tube 20 to further enforce the holding power of the clamp 10. It should be noted that this an optional part for the present invention bag and clothesline clamp and may not always be necessary.

Figure 2:
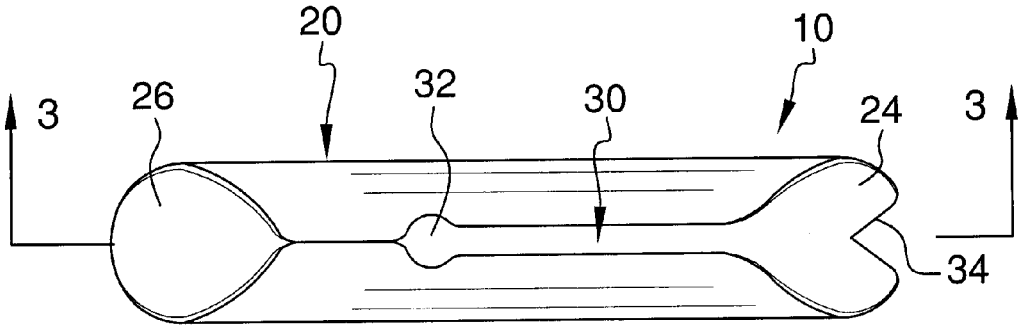
FIG. 2 is a top view of the present invention bag and clothesline clamp.
Figure 3:
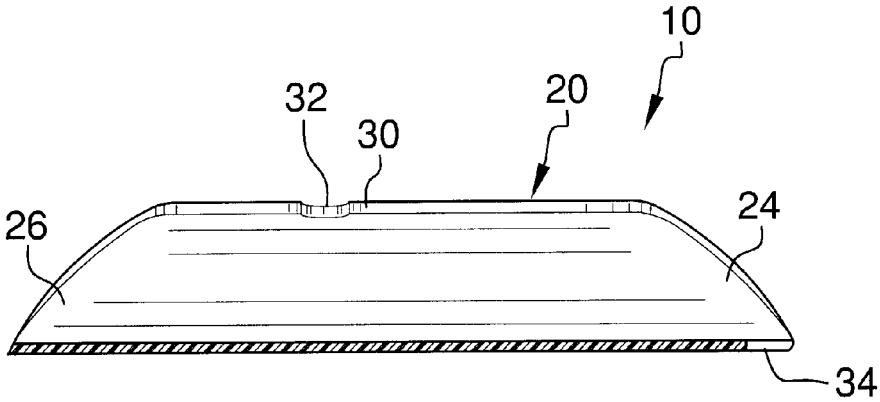
FIG. 3 is a cross-sectional view of the bag and clothesline clamp.
Figure 4:
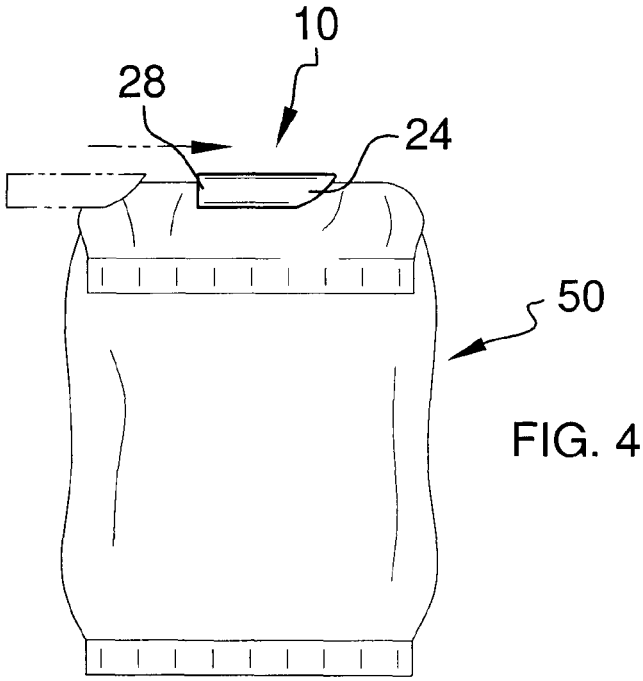
FIG. 4 is an illustration showing how the present invention bag and clotheslines clamp is used enclosing a bag.
Figure 5:
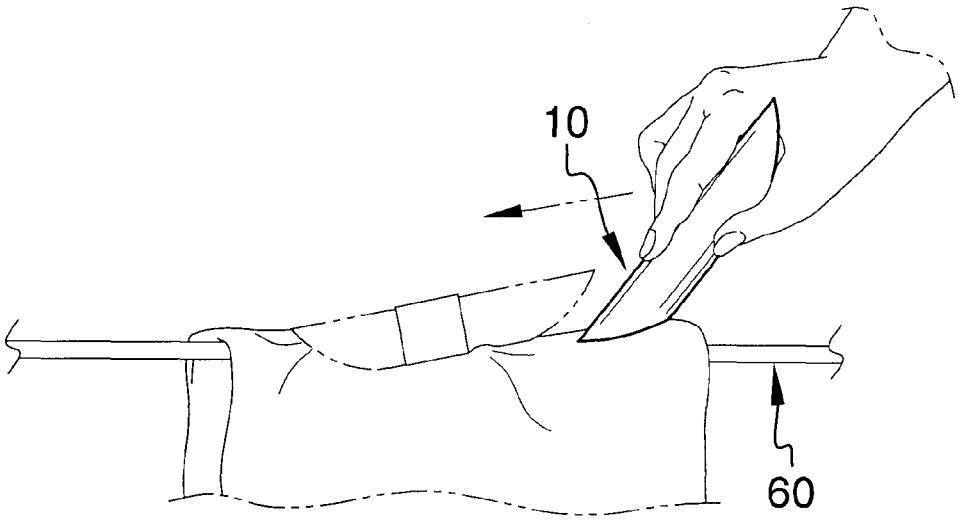
FIG. 5 is an illustration showing how the present invention bag and clothesline clamps is used on a clothesline.
Figure 6:
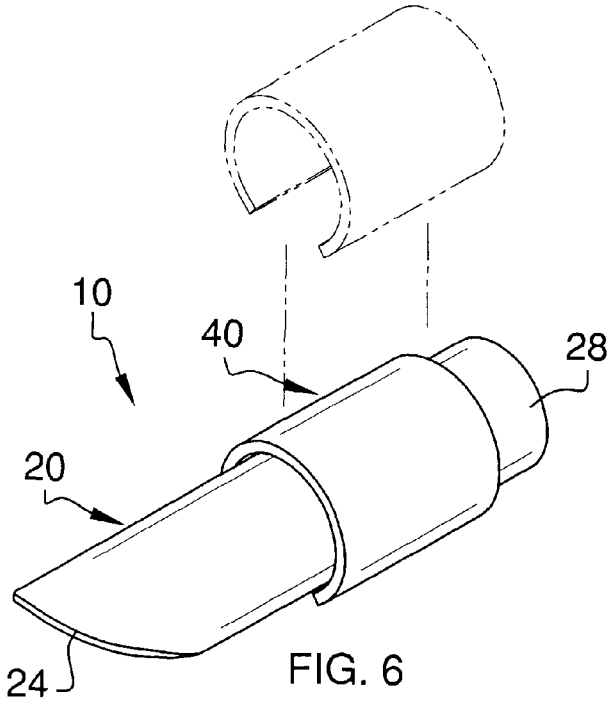
FIG. 6 is a perspective view of the present invention bag and clothesline clamps with the outer clamp locked thereon.
Figure 7:
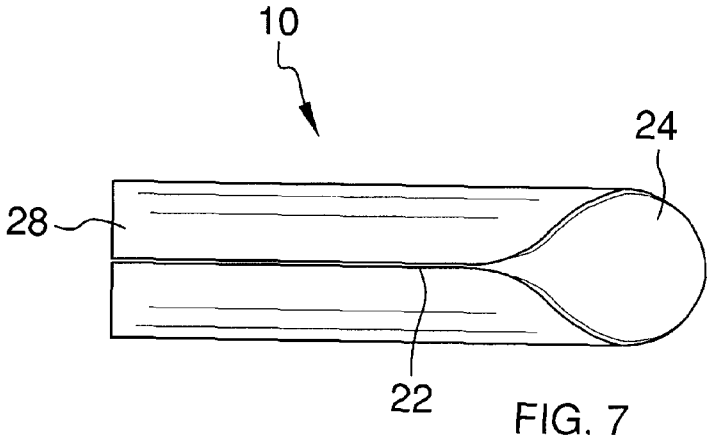
FIG. 7 is a top view of an alternate embodiment of the present invention bag and clothesline clamp.

FIG. 2 is a top view of the present invention bag and clothesline clamp 10. It is further shown that the slot opening 30 may have a circular shaped notched 32 at the end of the slot opening 30. A notch 34 is further provided at the open end 24 to facilitate positioning of the clamp 10 onto a clothesline 60. It should further be noted that the present invention bag and clothesline clamp 10 shown in FIG. 4 is a notched end 24 and a flat end 28. This is further shown in FIG. 7 in a top view and in FIG. 6 in a perspective view.

The present invention bag and clothesline clamp has therefore been amply described in the above descriptions and in the appended drawings of FIGS. 1-7. The length of pliable, tubular hose 20 can be suitably made of any flexible plastic material such as PVC, polyethylene, etc.

While the preferred embodiments of the invention have been described above, it will be recognized and understood that various modifications can be made in the invention and the appended claims are intended to cover all such modifications which may fall within the spirit and scope of the invention.

What is claimed is:

1. A bag and clotheslines clamp comprising:

a length of a pliable, tubular hose having a slit opening along said length and two opposite ends wherein at least one is notched at an angle of about 45° away from said slit opening;

a slot opening formed at least partially through said slit opening by removing a narrow strip of hose parallel to an axis of the hose for ease of insertion of a bag or a clothesline; and an outer C clamp for locking onto the length of the pliable, tubular hose.

2. The bag and clothesline clamp according to claim 1, wherein said length of the pliable, tubular hose is fabricated in a plastic selected from the group consisting of PVC, polyethylene and polyurethane.

3. The bag and clothesline clamp according to claim 1, wherein said slot opening terminates at a circular shaped notch.

* * * * *